US007497757B2

(12) United States Patent
Hamasaki

(10) Patent No.: US 7,497,757 B2
(45) Date of Patent: Mar. 3, 2009

(54) TOY TRANSPORT TRAILER

(75) Inventor: Takashi Hamasaki, Kanagawa (JP)

(73) Assignee: Kyosho Corporation, Tokyo (JP)

( * ) Notice: Subject to any disclaimer, the term of this patent is extended or adjusted under 35 U.S.C. 154(b) by 364 days.

(21) Appl. No.: 11/314,172

(22) Filed: Dec. 22, 2005

(65) Prior Publication Data

US 2006/0141901 A1 Jun. 29, 2006

(30) Foreign Application Priority Data

Dec. 28, 2004 (JP) ..... 2004-378994

(51) Int. Cl.
*A63H 17/00* (2006.01)
*A63H 17/05* (2006.01)

(52) U.S. Cl. ..... 446/78; 446/434

(58) Field of Classification Search ..... 446/77–78, 446/434; 320/107, 109
See application file for complete search history.

(56) References Cited

U.S. PATENT DOCUMENTS

| | | | | | |
|---|---|---|---|---|---|
| 2,956,536 | A | | 10/1960 | Kilvington | |
| 3,471,963 | A | * | 10/1969 | Eijiro | 446/429 |
| 3,629,680 | A | * | 12/1971 | Baynes et al. | 320/103 |
| 3,958,525 | A | | 5/1976 | Luthman | |
| 4,192,093 | A | * | 3/1980 | Hamano | 446/427 |
| 4,636,178 | A | * | 1/1987 | Oda | 446/462 |
| 5,232,393 | A | * | 8/1993 | Brown | 446/434 |
| 5,377,439 | A | | 1/1995 | Roos et al. | |
| 5,429,383 | A | * | 7/1995 | Reed | 280/414.1 |
| 5,583,414 | A | * | 12/1996 | Lawrence | 320/107 |
| 5,963,013 | A | * | 10/1999 | Watson et al. | 320/107 |
| 6,026,759 | A | | 2/2000 | Hazelett et al. | |
| 6,036,574 | A | * | 3/2000 | Halford | 446/429 |
| 6,110,003 | A | * | 8/2000 | Green | 446/428 |
| 6,468,127 | B1 | * | 10/2002 | Lee | 446/457 |
| 6,690,622 | B1 | | 2/2004 | Eckberg, Sr. et al. | |
| 6,967,463 | B1 | * | 11/2005 | Gordon et al. | 320/103 |
| 2006/0141897 | A1 | | 6/2006 | Hamasaki | |
| 2006/0183400 | A1 | | 8/2006 | Hamasaki | |

OTHER PUBLICATIONS

Kyosho Catalog and Handbook 2004, pp. 189-198.

* cited by examiner

*Primary Examiner*—Eugene Kim
*Assistant Examiner*—Alyssa M Hylinski
(74) *Attorney, Agent, or Firm*—Nixon & Vanderhye P.C.

(57) ABSTRACT

An electric motor toy transport trailer configured to transport an electric motor toy 21 includes a charger 17 includes a rechargeable main power source 17*a* and a charging connector 17*c* connected to the rechargeable main power source 17*a* via a cord 17*b*. The rechargeable main power source 17*a* is housed in the electric motor toy transport trailer body 12 in a manner such that the rechargeable main power source 17*a* is disposed at a position lower than the upper edge of tires 13. The charging connector 17*c* is stored in an openable and closable container box 14 provided on the electric motor toy transport trailer body 12.

9 Claims, 14 Drawing Sheets

TOY TRANSPORT TRAILER

BACKGROUND OF THE INVENTION

1. Field of the Invention

The present invention relates to an electric motor toy transportation trailer configured to transport an electric motor toy.

2. Description of the Related Art

A known electric motor toy transportation trailer is used only for transporting an electric motor toy. Also, a known mounting base for loading an electric motor toy is used only for loading and displaying the electric motor toy.

For reference, refer to non-patent document "Catalog and Handbook 2004" (pp. 189-198) issued by Kyosho Corporation.

SUMMARY OF THE INVENTION

Since a known electric motor toy transportation trailer and a known mounting base are used only for transporting an electric motor toy, the electric motor toy transportation trailer and the mounting base are not capable of charging a power source of an electric motor toy.

The prevent invention solves the above-identified problems by providing an electric motor toy transportation trailer capable of charging a power source of an electric motor toy.

An electric motor toy transport trailer according to a first aspect of the present invention is configured to transport an electric motor toy and includes an electric motor toy transport trailer body, and a charger configured to charge a power source of the electric motor toy, the charger being disposed on the electric motor toy transport trailer body.

As a second aspect of the present invention, the electric motor toy transport trailer according to the first aspect of the present invention may include the charger having a rechargeable main power source and a charging connector connected to the rechargeable main power source via a cord and the rechargeable main power source being housed in the electric motor toy transport trailer body.

As a third aspect of the present invention, the electric motor toy transport trailer according to the second aspect of the present invention may include the rechargeable main power source being housed in the electric motor toy transport trailer body in a manner such that the rechargeable main power source is disposed at a position lower than the upper edge of tires.

As a fourth aspect of the present invention, the electric motor toy transport trailer according to one of the second and third aspects of the present invention may include the charging connector being stored in an openable and closable container box provided on the electric motor toy transport trailer body.

As a fifth aspect of the present invention, the electric motor toy transport trailer according to one of the second to fourth aspects of the present invention may include the electric motor toy being a toy boat having a depression on the bottom of the toy boat and a plurality of protrusions provided on a cover of a rechargeable main power source container configured to store the rechargeable main power source of the electric motor toy transport trailer body, wherein the plurality of protrusions supporting the toy boat by entering the depression.

According to the present invention, since the charger configured to charge the power source of the electric motor toy is provided on the electric motor toy transportation trailer body, the power source of the electric motor toy can be charged using the electric motor toy transportation trailer.

Since the charger includes the charging power source and the charging connector connected to the charging power source via the cord and since the charging power source is housed in the electric motor toy transportation trailer body, the charging power source can be provided on the electric motor toy transportation trailer body without changing the appearance of the electric motor toy transportation trailer.

Since the charging power source is housed in the electric motor toy transportation trailer body by disposing the charging power source at a position lower than the upper edge of the tires, the center of gravity is lowered. In this way, stability is improved, and the electric motor toy transportation trailer can be prevented from falling over.

Since the charging connector is stored in the openable and closable container box provided on the electric motor toy transport trailer body, the charging connector can be stored in the container box when not being used. As a result, the toy boat has a simple figure.

Since the electric motor toy is a toy boat having the depression at the bottom of the toy boat and since the plurality of protrusions configured to support the toy boat by entering the depression of the toy boat is provided on the cover of the rechargeable main power source container configured to store the rechargeable main power source of the electric motor toy transport trailer body, the toy boat can be loaded on the electric motor toy transport trailer and transported in a stable manner.

DESCRIPTION OF THE PREFERRED EMBODIMENTS

An embodiment of the present invention will be described below with reference to the drawings.

A toy boat 21 according to the embodiment described below is an electric motor toy including an electric motor as a driving source.

First, an electric motor toy transport trailer will be described.

Figure 1:
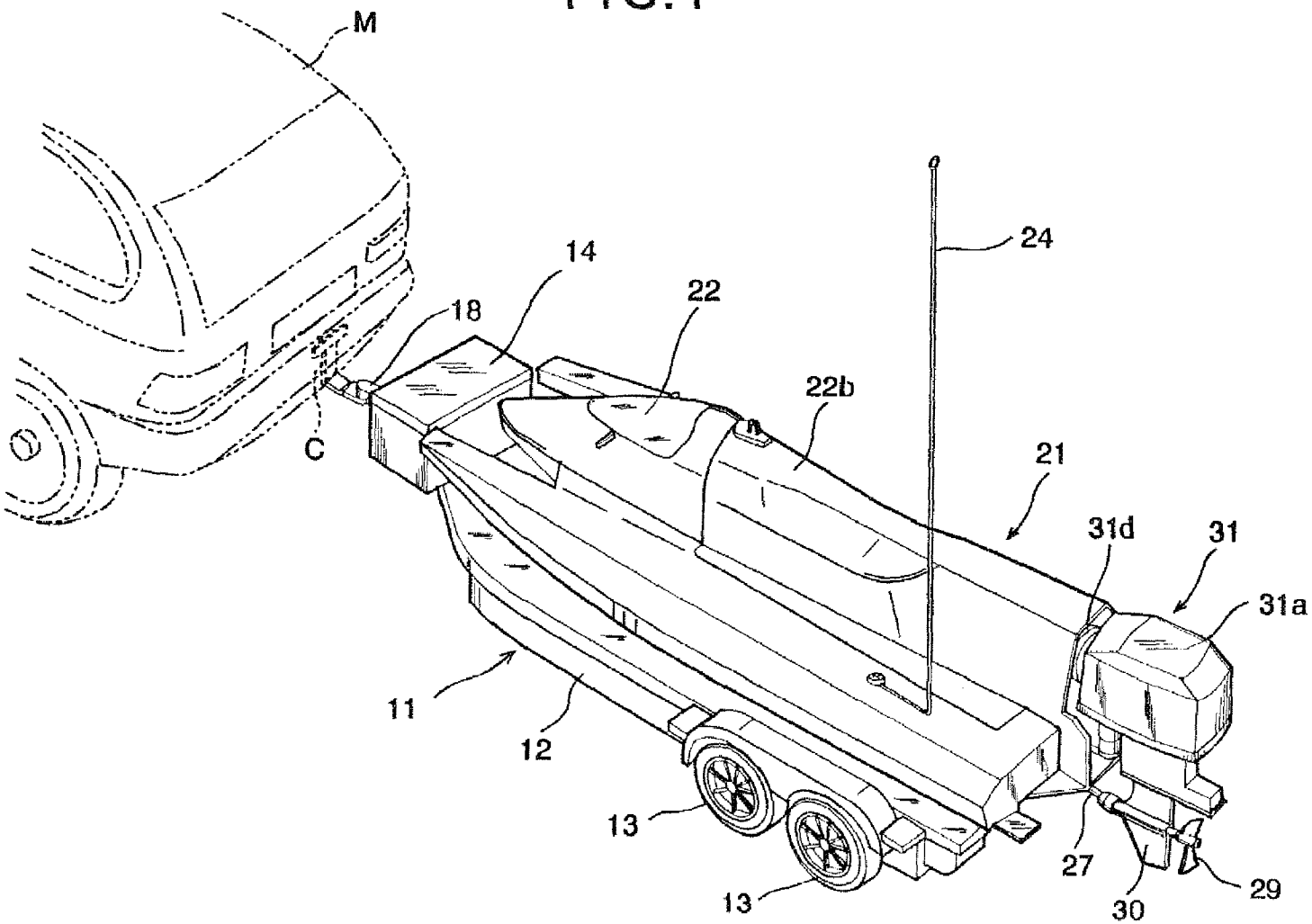
FIG. 1 is a perspective view of a toy boat loaded on an electric motor toy transport trailer that is coupled to a toy automobile with a coupler.
Figure 2:
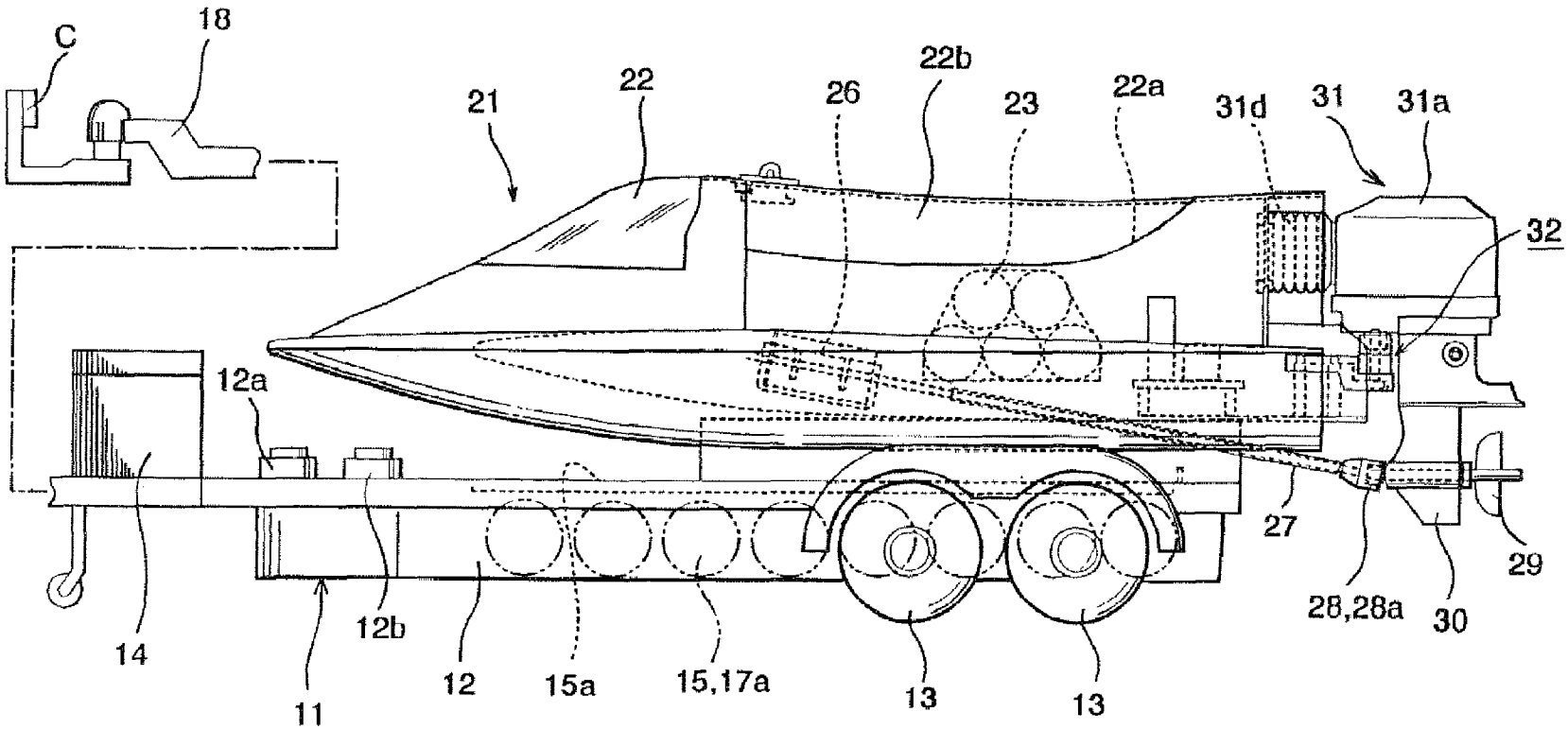
FIG. 2 is a side view of the electric motor toy transport trailer shown in FIG. 1.
Figure 3:
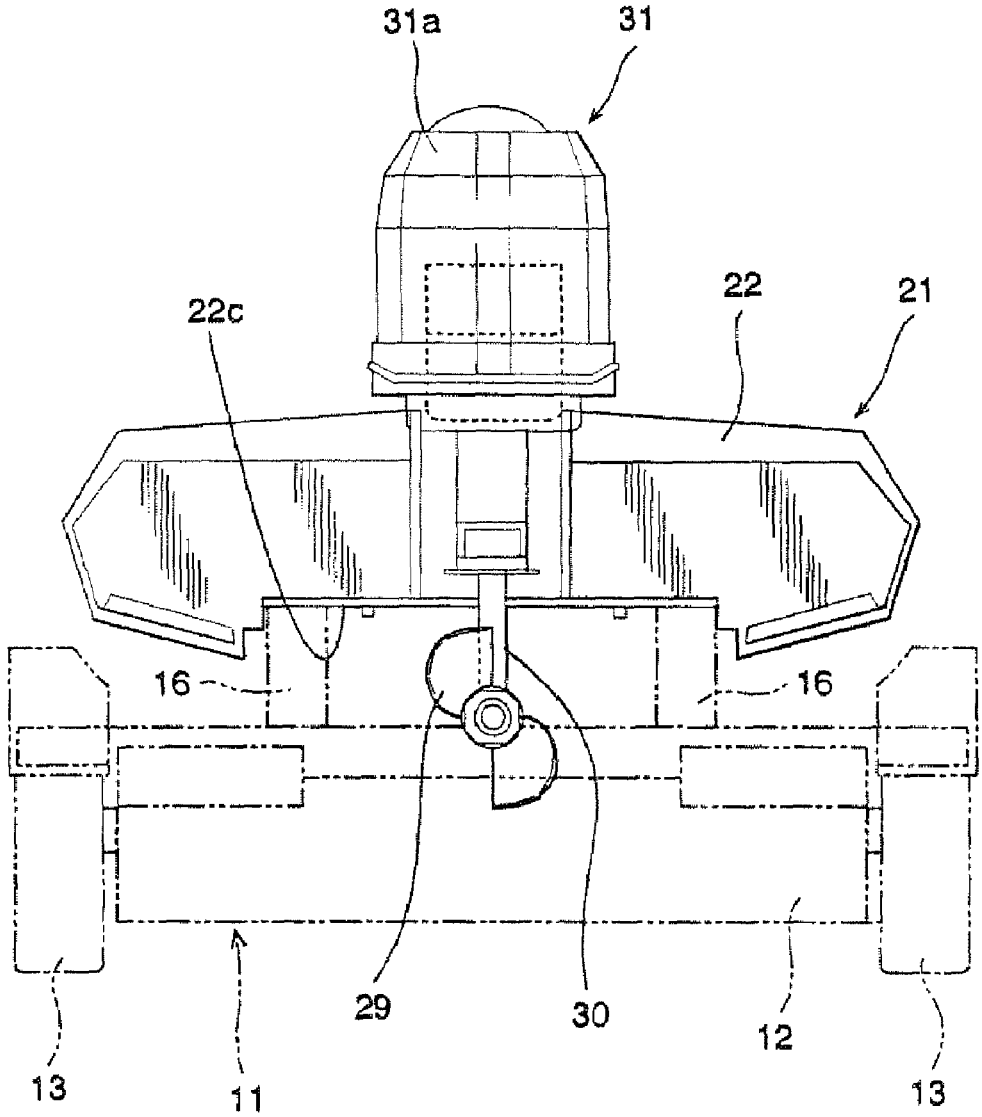
FIG. 3 is a back view of the electric motor toy transport trailer shown in FIG. 1.
Figure 4:
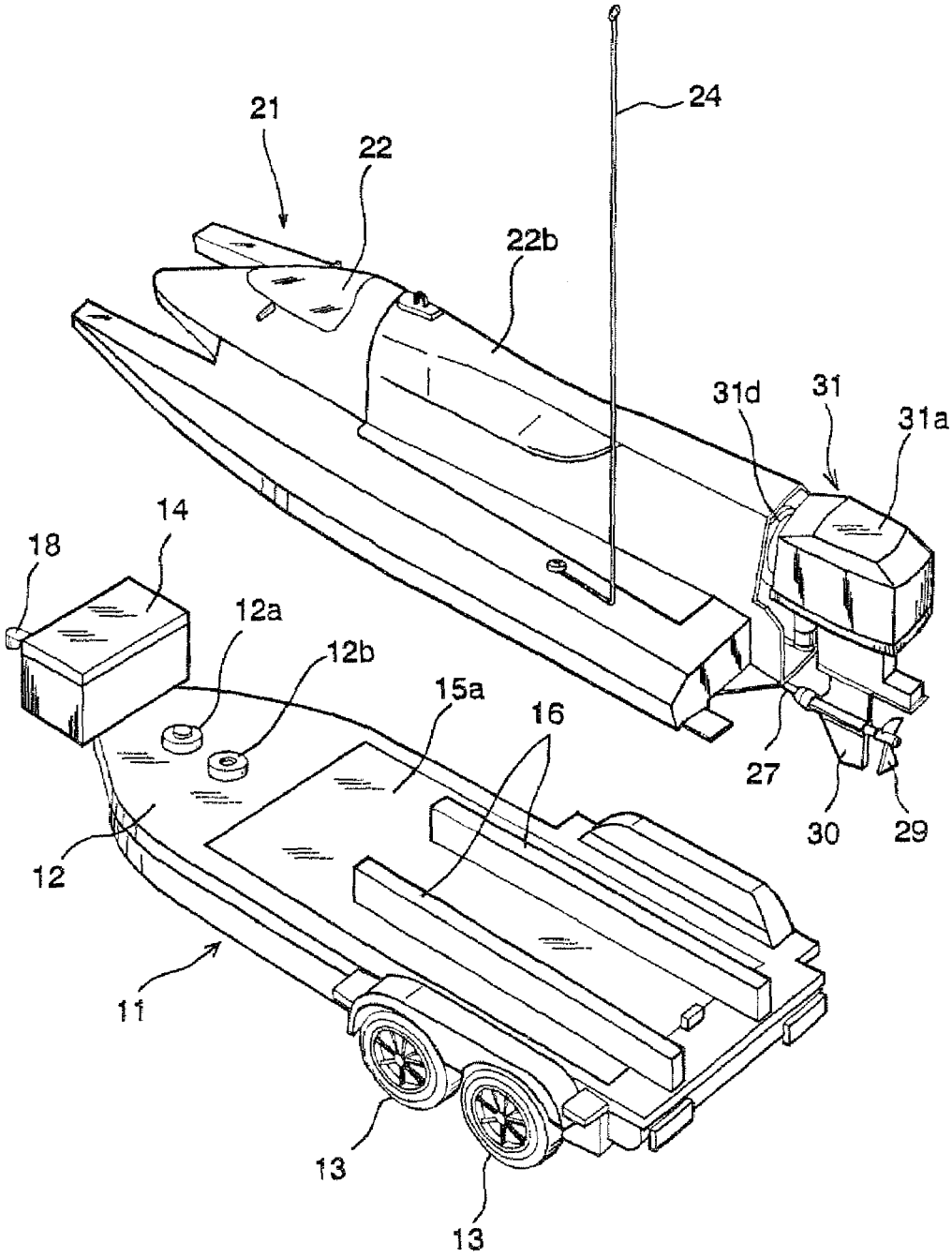
FIG. 4 is a perspective view of a toy boat removed upward from the electric motor toy transport trailer.
Figure 5:
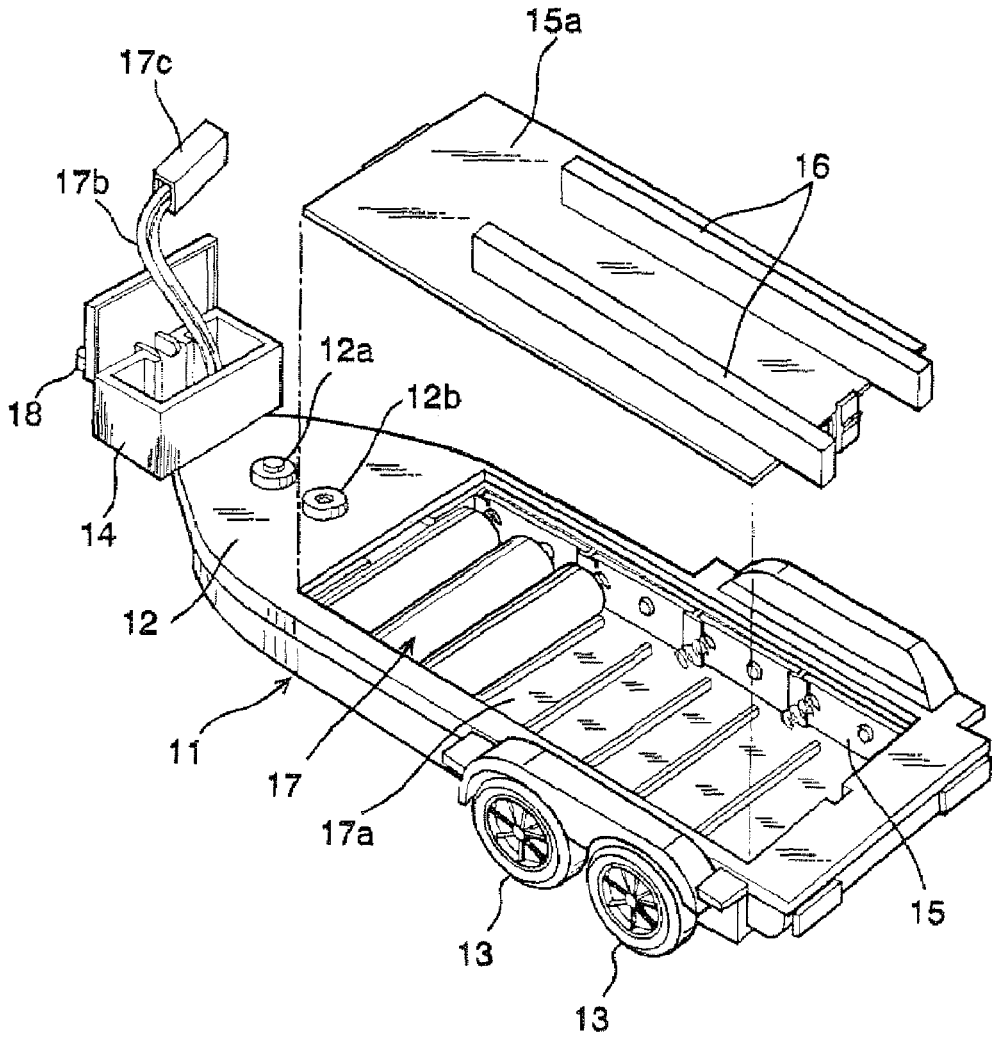
FIG. 5 is a perspective view of a rechargeable main power source container for the electric motor toy transport trailer with the cover of a container box opened.
Figure 6:
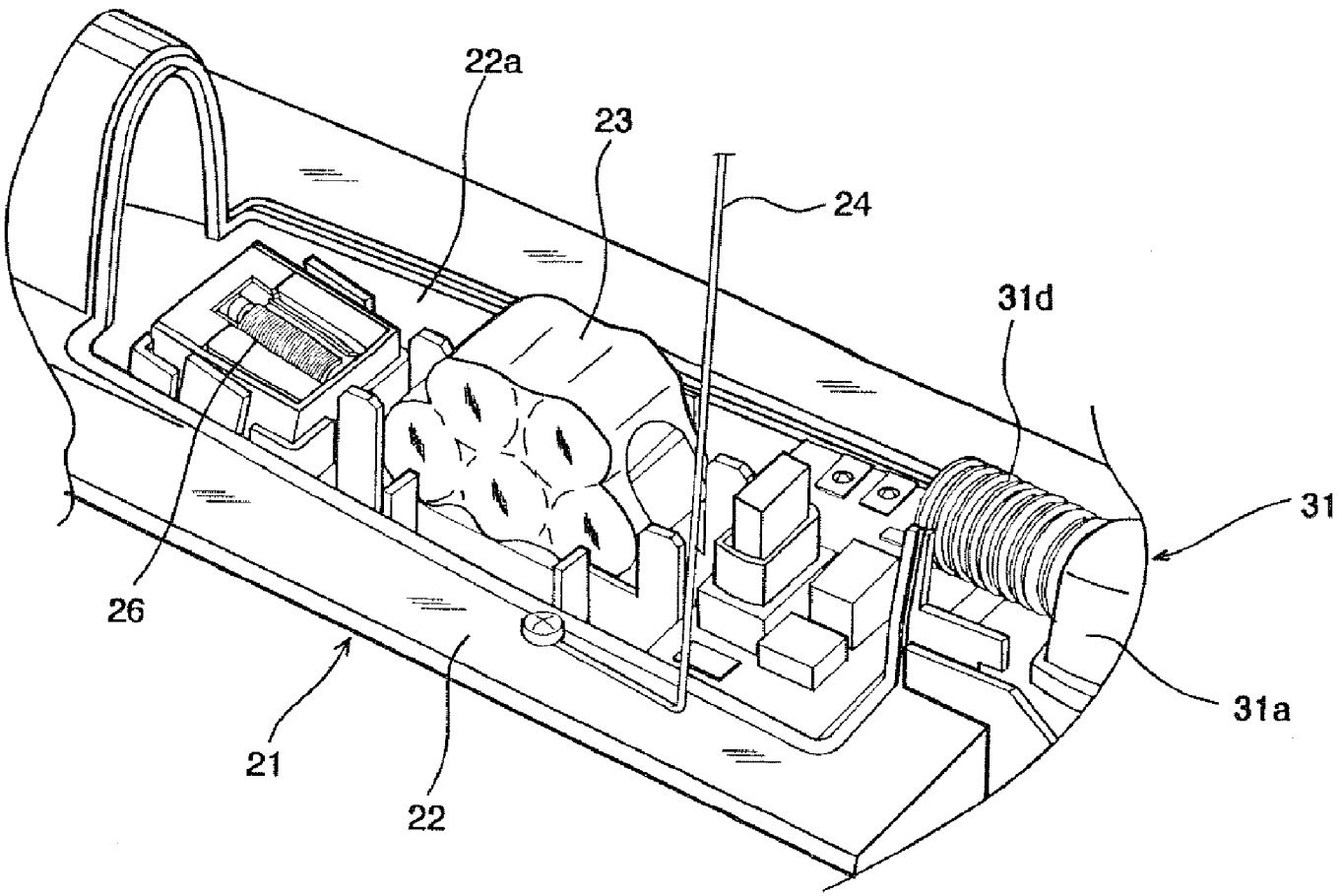
FIG. 6 is a partial perspective view of the toy boat with the cover removed to expose the power source.

FIG. 1 is a perspective view of a toy boat loaded on an electric motor toy transport trailer that is coupled to a toy automobile with a coupler. FIG. 2 is a side view of the electric motor toy transport trailer shown in FIG. 1. FIG. 3 is a back view of the electric motor toy transport trailer shown in FIG. 1. FIG. 4 is a perspective view of a toy boat removed upward from the electric motor toy transport trailer. FIG. 5 is a perspective view of a rechargeable main power source container for the electric motor toy transport trailer with the cover of a container box opened. FIG. 6 is a partial perspective view of the toy boat with the cover removed to expose the power source. In FIG. 3, the electric motor toy transport trailer is illustrated in a changed double-dotted line to so that the toy boat stands out in the drawing.

There drawings illustrates an electric motor toy transport trailer 11 that includes an electric motor toy transport trailer body 12 and a coupler 18 provided on the electric motor toy transport trailer body 12 so as to couple the electric motor toy transport trailer body 12 with a coupler C of a toy automobile M.

Tires 13 are attached to the electric motor toy transport trailer body 12, enabling the electric motor toy transport trailer body 12 to be pulled and moved by the toy automobile M. A container box 14 is provided at the rear part of the couple 18, i.e., the upper portion of the tip of the electric motor toy transport trailer body 12, so that the container box 14 does not interfere with the toy boat 21 loaded on the electric motor toy transport trailer body 12. Also, a rechargeable main power source container 15 with a cover 15*a* configured to contain a rechargeable main power source 17*a* constituting a charger 17 is provided at the center of the electric motor toy transport trailer body 12.

On the upper side of the cover 15*a* of the rechargeable main power source container 15, a plurality of (e.g., two) protrusions 16 having a predetermined height is provided so as to support the toy boat 21 from below. The charger 17 includes a power source (e.g., battery), the rechargeable main power source 17*a* stored in the rechargeable main power source container 15, a cord 17*b* being connected to the rechargeable main power source 17*a* and extending into the container box 14 through the electric motor toy transport trailer body 12, and a charging connector 17*c* being connected to the cord 17*b* and stored in the container box 14. The rechargeable main power source 17*a* is stored in the rechargeable main power source container 15 so that it is positioned below the upper edge of the tires 13.

The inner side of a boat body 22 of the toy boat 21 is a container 22*a*. The container 22*a* stores various components, such as a power source 23 detachable from the container 22*a*. The opening of the container 22*a* is watertightly closed with a cover 22*b*. At the bottom of the boat body 22, a depression 22*c* penetrating through the boat body 22 in the longitudinal direction is provided.

To load the toy boat 21 on the electric motor toy transport trailer 11 having the above-described structure, the depression 22*c* provided in the lower portion of the boat body 22 is aligned with the protrusions 16 of the cover 15*a* in a manner such that the protrusions 16 enter the depression 22*c*, as shown in FIG. 4, so as to support the toy boat 21.

To transport the toy boat 21 with the electric motor toy transport trailer 11, first, the toy boat 21 is loaded on the electric motor toy transport trailer 11, as described above, and, then, the coupler 18 is coupled with the toy automobile M. In this way, the toy boat 21 can transported on the electric motor toy transport trailer 11 by moving the toy automobile M.

To charge the power source 23 of the toy boat 21, as shown in FIG. 6, first, the cover 22*b* is removed to remove the power source 23 from the boat body 22. Then, as shown in FIG. 5, the container box 14 is opened to remove the charging connector 17*c* from the container box 14 and to connect the charging connector 17*c* with the power source 23. Subsequently, a switch 12*a* mounted on the upper surface of the electric motor toy transport trailer body 12 is pushed to illuminate a light-emitting diode 12*b* that indicates the charging of the power source 23 and charge the power source 23. After the charging is completed, the charging connector 17*c* is stored in the container box 14, and then the container box 14 is closed. In the front of the rechargeable main power source container 15, a control substrate configured to drive the light-emitting diode 12*b* and to regulate the power charging the power source 23 is provided.

As described above, since the charger 17 configured to charge the power source 23 of the toy boat 21 is provided on the electric motor toy transport trailer body 12, the power source 23 of the toy boat 21 can be charged with the electric motor toy transport trailer 11. Furthermore, since the charger 17 includes the rechargeable main power source 17*a* and the charging connector 17*c* connected to the rechargeable main power source 17*a* via the cord 17*b* and since the rechargeable main power source 17*a* is housed in the electric motor toy transport trailer body 12, the rechargeable main power source 17*a* can be provided on the electric motor toy transport trailer body 12 without changing the appearance of the electric motor toy transport trailer body 12.

Moreover, since the rechargeable main power source 17*a* is housed in the electric motor toy transport trailer body 12 in a manner such that the rechargeable main power source 17*a* is disposed at a position lower than the upper edge of the tires 13, the center of gravity is lowered and stability is increased. Accordingly, the toy boat 21 is prevented from turning over. Since the charging connector 17*c* is stored in the openable and closable container box 14 provided on the electric motor toy transport trailer body 12, the charging connector 17*c* can be stored in the container box 14 when not being used. As a result, the toy boat 21 has a simple figure.

Since the depression 22*c* is provided at the bottom of the toy boat 21 and since the plurality of protrusions 16 configured to support the toy boat 21 by entering the depression 22*c* of the toy boat 21 is provided on the cover 15*a* of the rechargeable main power source container 15 configured to store the rechargeable main power source 17*a* of the electric motor toy transport trailer body 12, the toy boat 21 can be loaded on the electric motor toy transport trailer 11 and transported in a stable manner.

Next, the toy boat 21 is described.

Figure 7:
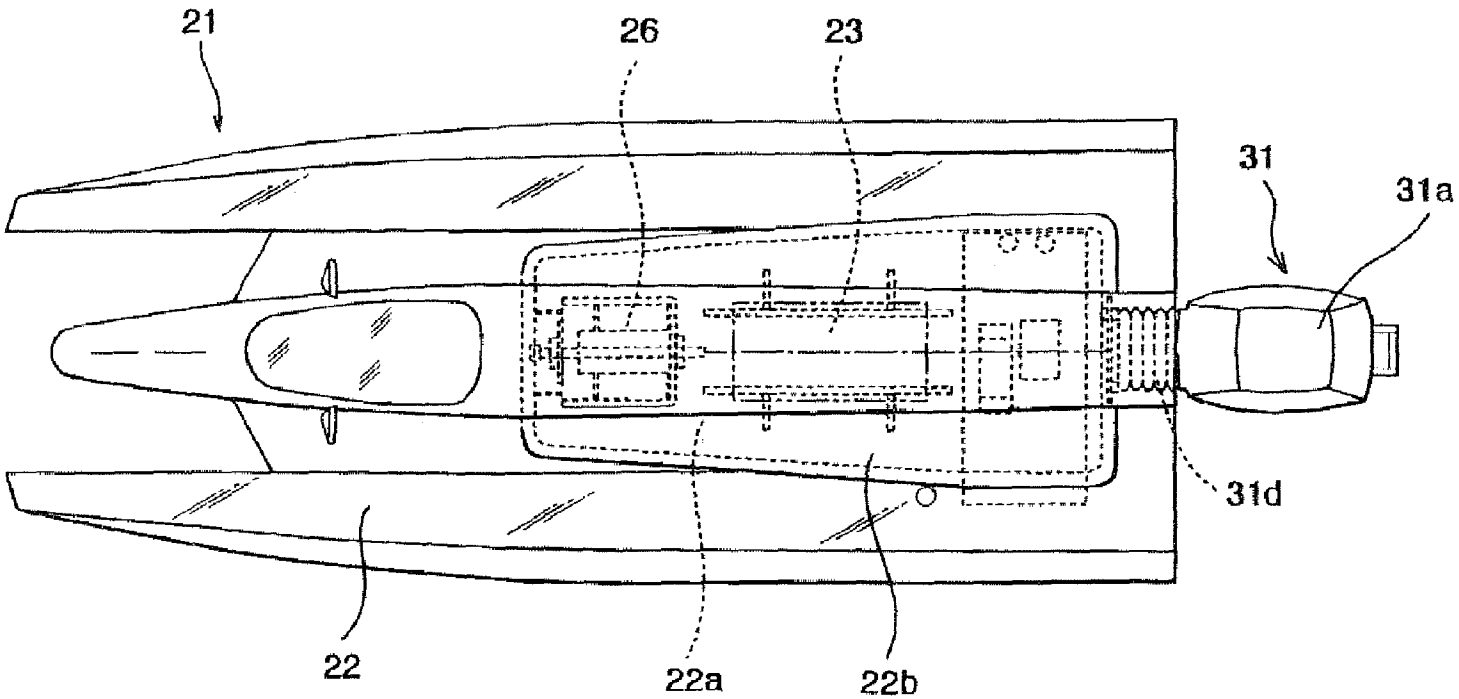
FIG. 7 is a plan view of the toy boat.
Figure 8:
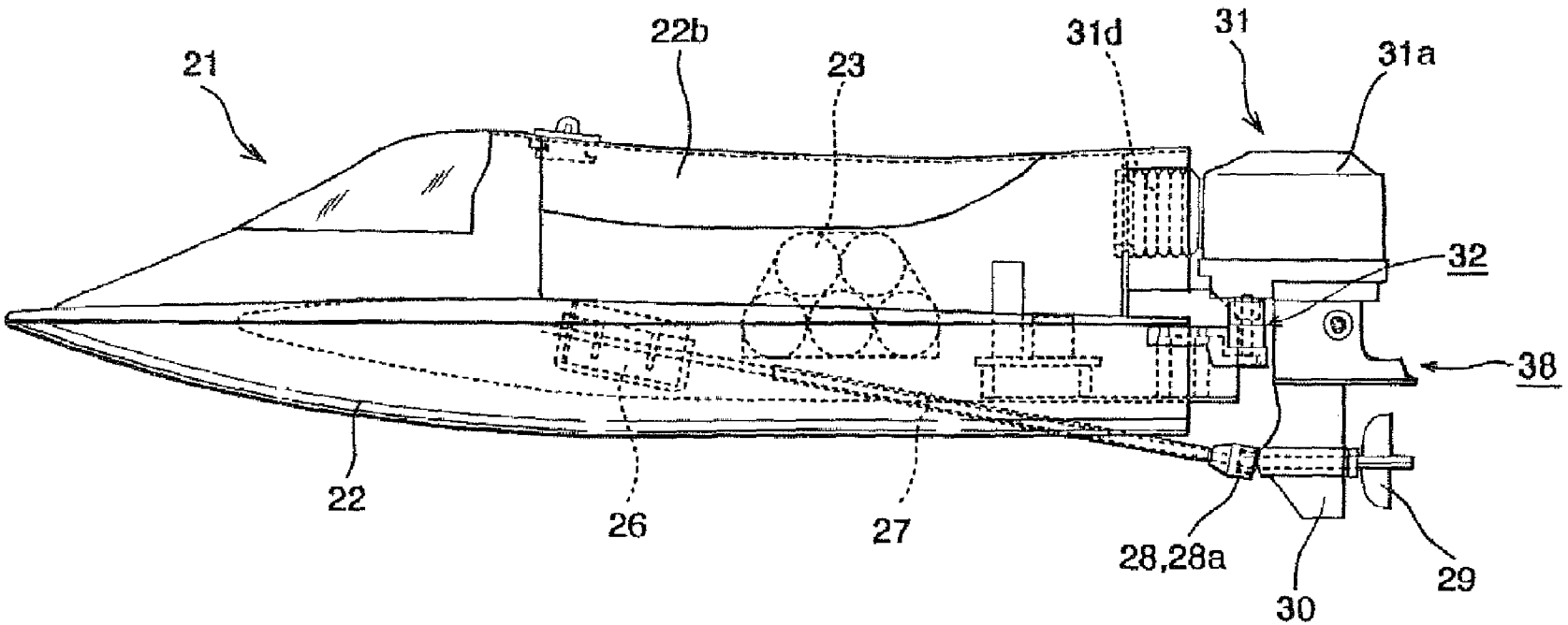
FIG. 8 is a side view of the toy boat.
Figure 9:
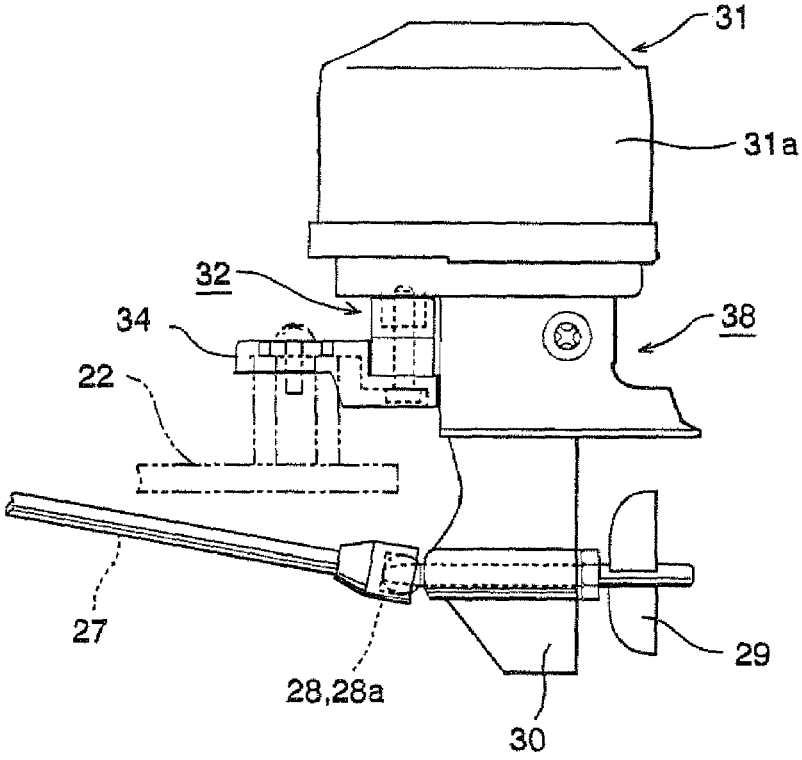
FIG. 9 is a side view of the servo mechanism and a screw in a mounted state.
Figure 10:
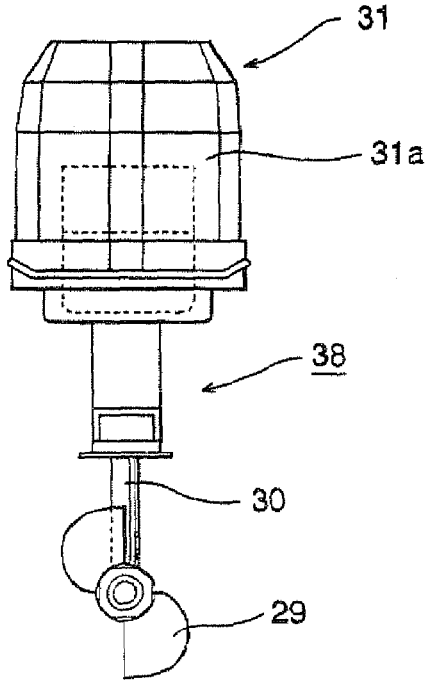
FIG. 10 is a back view of the servo mechanism and the screw in a mounted state.
Figure 11:
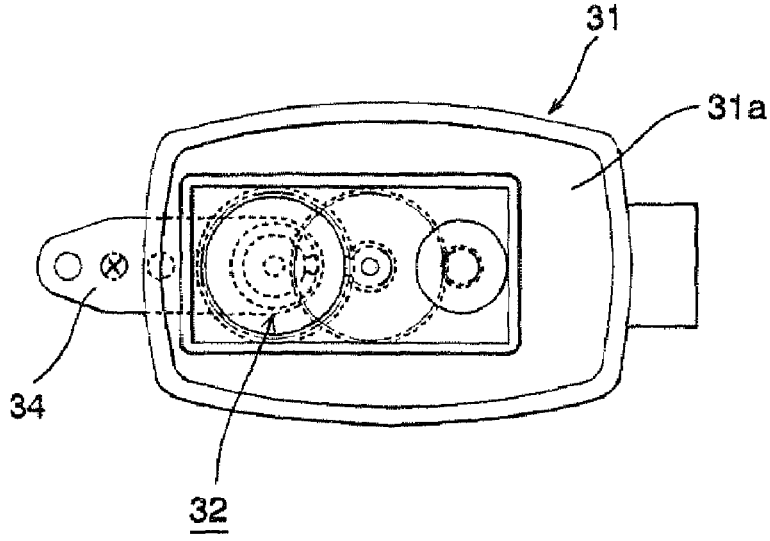
FIG. 11 is plan view illustrating the overall structure of the servo mechanism.
Figure 12:
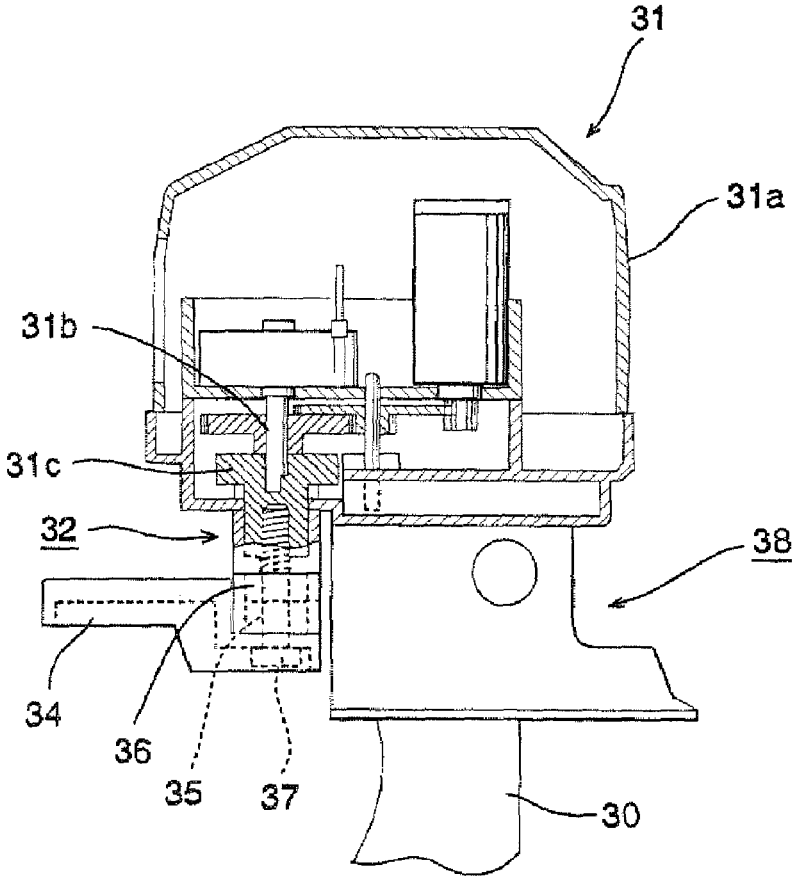
FIG. 12 is a longitudinal cross-sectional view of the servo mechanism.
Figure 13:
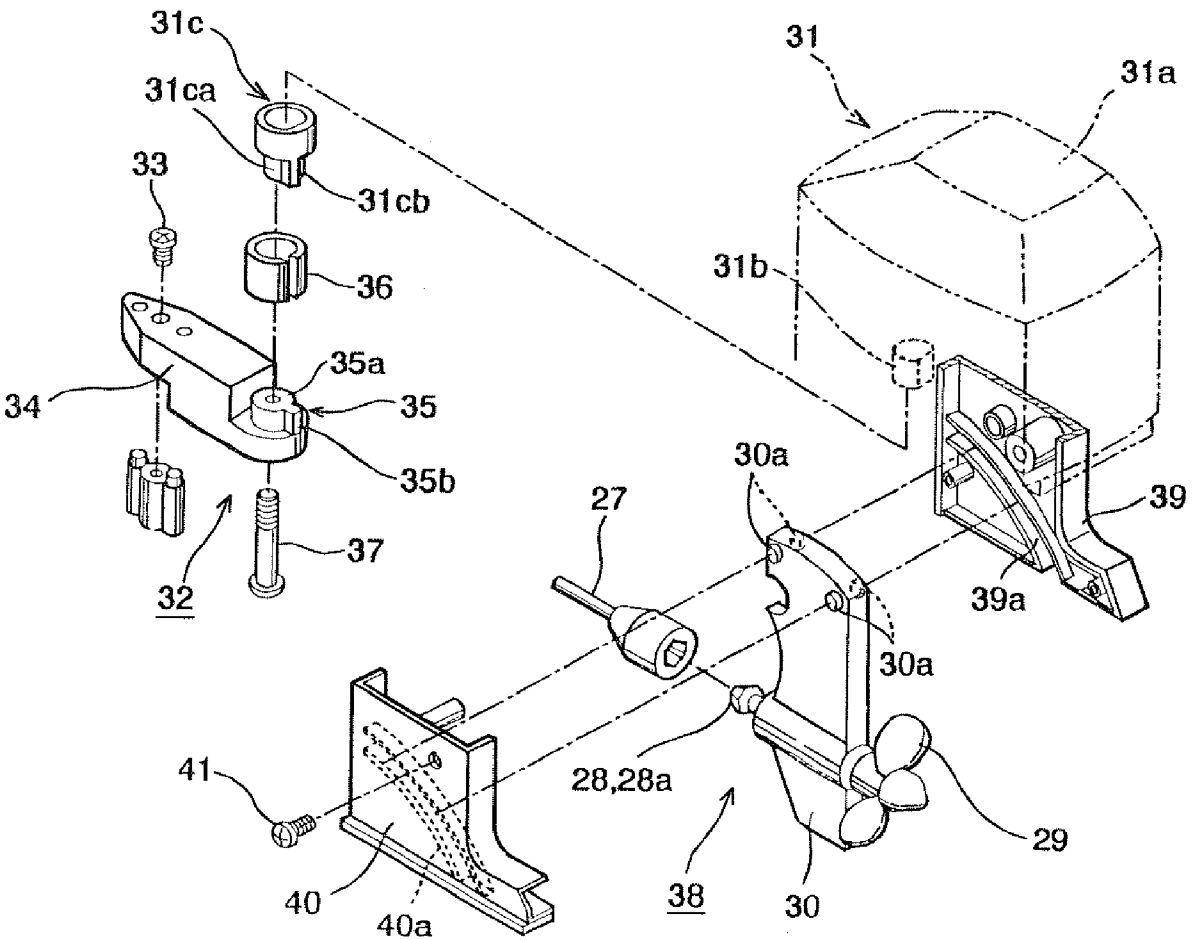
FIG. 13 is an exploded view illustrating the structure of an impact absorption mechanism and a screw-angle adjustment mechanism.
Figure 14:
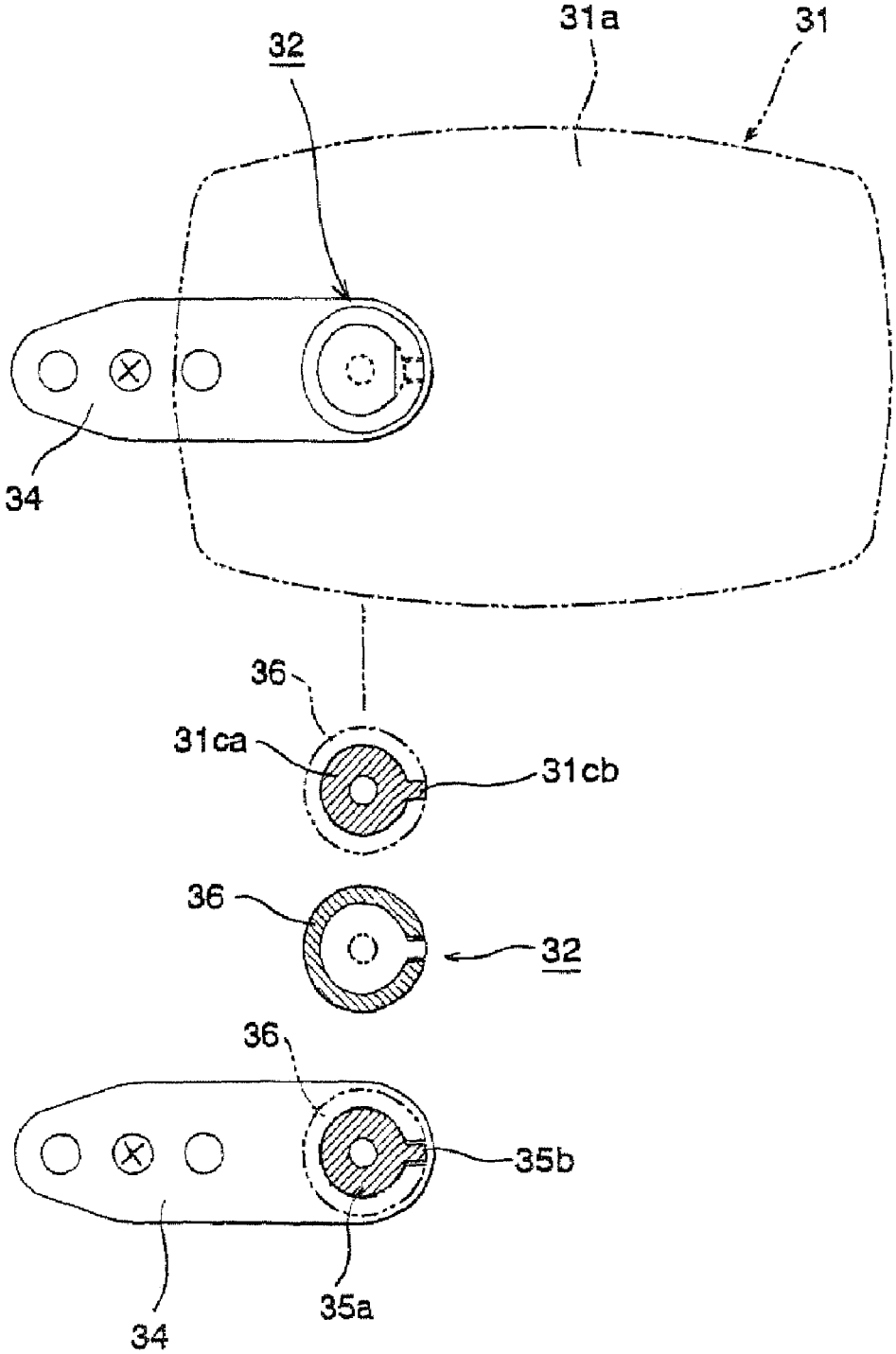
FIG. 14 is a schematic view illustrating the steering and the operation of the impact absorption mechanism.
Figure 15:
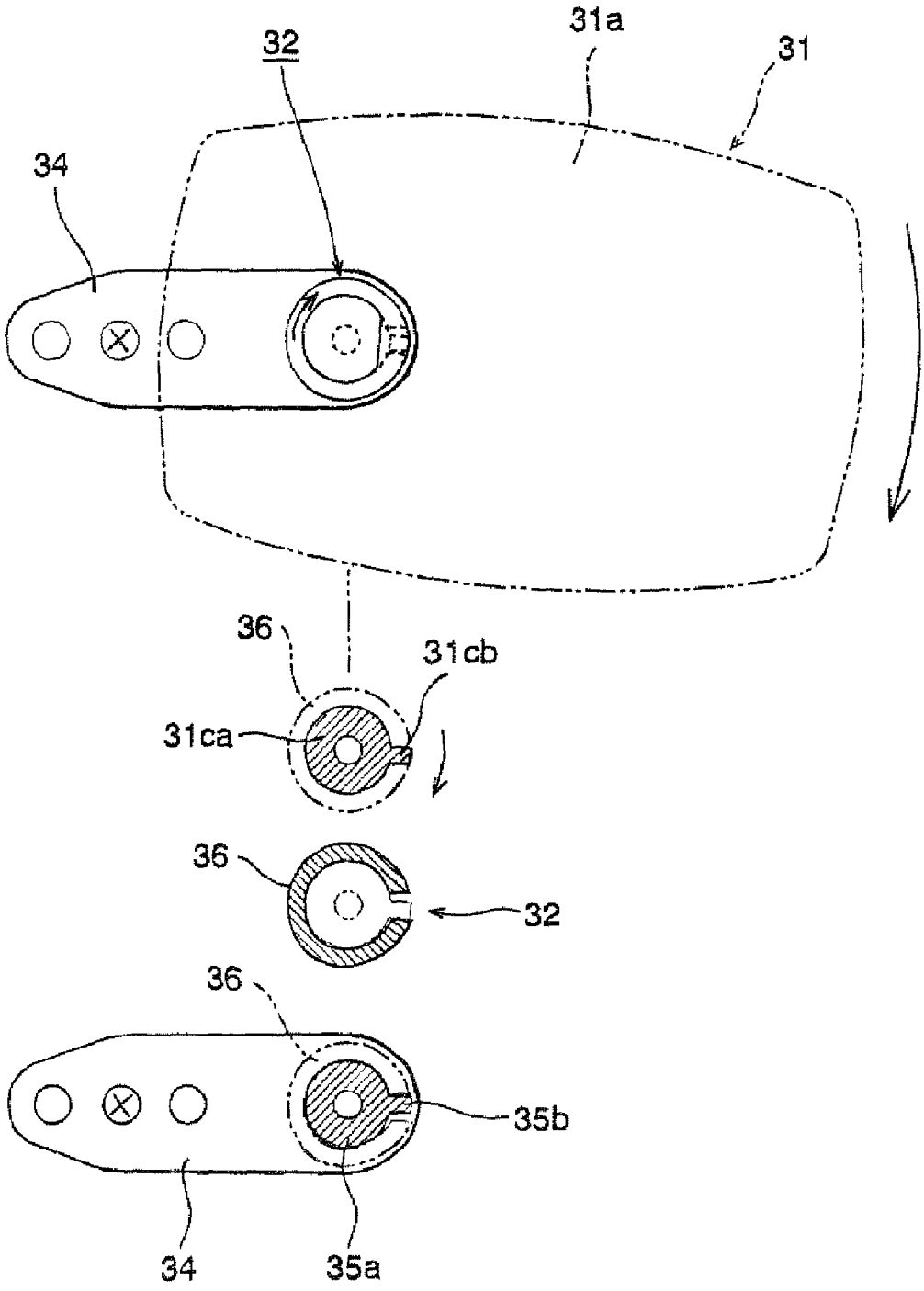
FIG. 15 is a schematic view illustrating the steering and the operation of the impact absorption mechanism.
Figure 16:
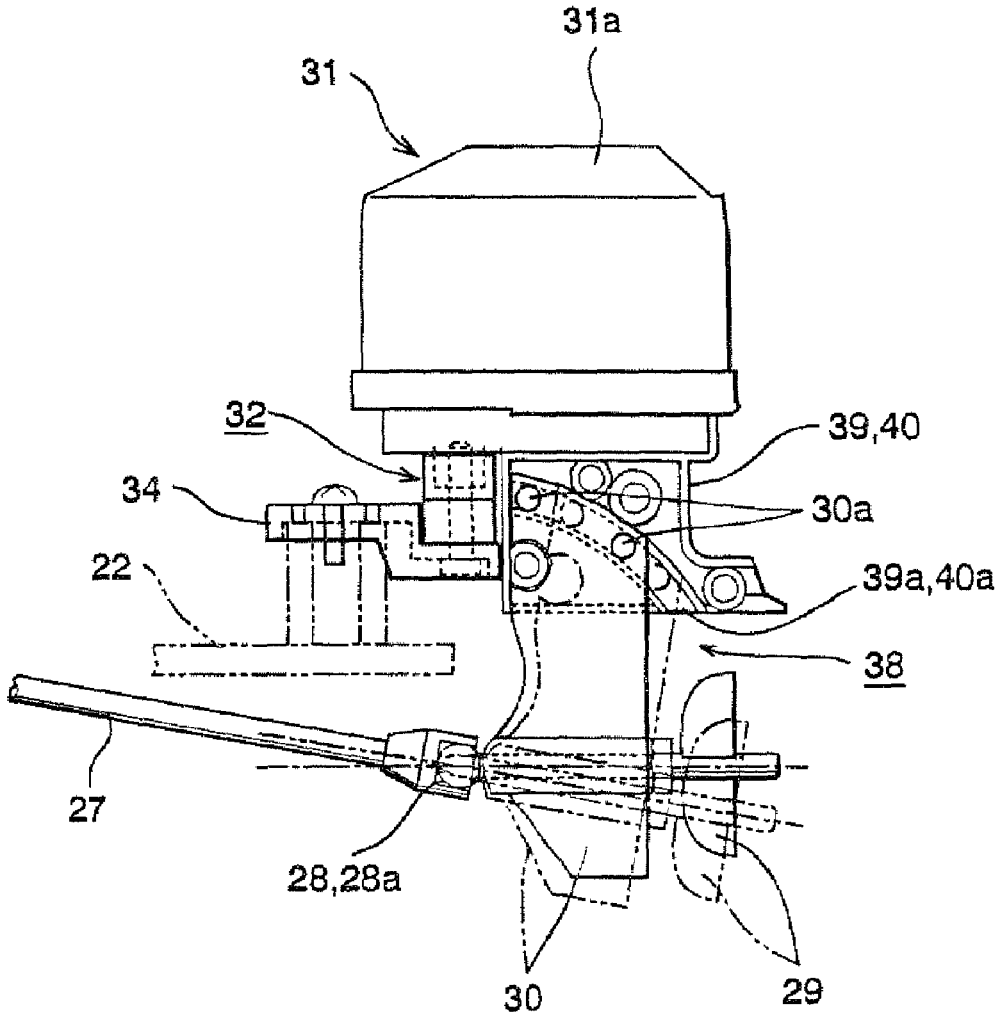
FIG. 16 is a schematic view illustrating the operation of the screw-angle adjustment mechanism.

FIG. 7 is a plan view of the toy boat. FIG. 8 is a side view of the toy boat. FIG. 9 is a side view of the servo mechanism and a screw in a mounted state. FIG. 10 is a back view of the servo mechanism and the screw in a mounted state. FIG. 11 is plan view illustrating the overall structure of the servo mechanism. FIG. 12 is a longitudinal cross-sectional view of the servo mechanism. FIG. 13 is an exploded view illustrating the structure of an impact absorption mechanism and a screw-angle adjustment mechanism. FIGS. 14 and 15 are schematic views illustrating the steering and the operation of the impact absorption mechanism. FIG. 16 is a schematic view illustrating the operation of the screw-angle adjustment mechanism.

As shown in the drawings, the toy boat 21 includes the boat body 22, the rechargeable power source 23 detachable from the boat body 22 and capable of supplying electric power to various components, an antenna 24 mounted on the boat body 22 and capable of receiving a control signal from the a controller not shown in the drawings, a controlling unit (not shown in the drawings) mounted on the inner side of the boat body 22 and capable of controlling the various components on the basis of a signal from the antenna 24, an electric motor 26 mounted on the inner side of the boat body 22 and controlled by the controlling unit, a driving shaft 27 having a first end attached to the rotary shaft of the electric motor 26 and a second end extending outside the boat body 22, a screw 29 connected to the second end of the driving shaft 27 located outside the boat body 22 with a hexagonal universal joint 28 having a hexagonal pyramid, a screw bracket 30 functioning as a rudder configured to rotatably support the screw 29, a servo mechanism 31 configured to turn the screw bracket 30 towards a horizontal position, an impact absorption mechanism 32 configured to mount the servo mechanism 31 on the outer side of the boat body 22 so that the servo mechanism 31 can be turned towards a horizontal position and to transmit power generated at the servo mechanism 31 to the screw bracket 30, and a screw angle and depth adjustment mechanism 38 (hereinafter simply referred to as a "screw adjustment mechanism 38") configured to adjust the screw angle and the screw depth. Also, a flexible pipe 31*d* is provided to cover the outer periphery of the cord used to connect the controlling unit (not shown) and the servo mechanism 31 and to prevent water from entering the servo mechanism 31.

The inner side of the boat body 22 is the container 22*a*. The container 22*a* stores various components. The opening of the container 22*a* is watertightly closed with the cover 22*b*.

At the bottom of the boat body 22, as shown in FIG. 3, the depression 22*c* penetrating through the boat body 22 in the longitudinal direction is provided.

On the left and right sides of the screw bracket 30, a plurality of (e.g., two) protrusions 30*a* is provided on a circle centered on a connecting part 28*a* of the driving shaft 27 and the hexagonal universal joint 28 in a manner such that, for example, pairs of the protrusions 30*a* are at same positions with respect to the circle.

Components, such as an electric motor and gears, are watertightly housed in a housing 31*a* of the servo mechanism 31, and signal lines from the boat body 22 are also sealed in a bellow-like sealed tube. The final stage transmission shaft 31*b*, as shown in FIG. 13, has a D-cut lower end. The D-cut portion is attached to a shaft end portion 31*c* having a protrusion 31*cb* protruding from the outer circumference of a circular cylinder 31*ca* along the shaft direction and being rotatable with the transmission shaft 31*b*.

The impact absorption mechanism 32, as shown in FIG. 13, includes a support shaft 35 being provided on the upper rear edge of a support member 34 mounted on the stern of the boat body 22 with a fixing screw 33 and having a protrusion 35*b* protruding from the outer circumference of a shaft 35*a* along the shaft direction, the shaft end portion 31*c* of the servo mechanism 31, an elastic C-ring member 36 holding the protrusions 31*cb* and 35*b* in a gap and embracing the circular cylinder 31*ca* and the shaft 35*a*, and an attachment screw 37 configured to fix the shaft end portion 31*c*, the support shaft 35, and the C-ring member 36 on the support member 34.

The screw adjustment mechanism 38, as shown in FIG. 13, includes a first fixing bracket 39 whose upper edge is attached to the housing 31*a* of the servo mechanism 31, a second fixing bracket 40 attached to the first fixing bracket 39 with a fixing screw 41, and the screw bracket 30 includes the protrusions 30*a* interposed and fixed between the first and second arc-shaped grooves 39*a* and 40*a*. The first fixing bracket 39 includes a first arc-shaped groove 39*a* being center around the connecting part 28*a*. The second fixing bracket 40 includes a second arc-shaped groove 40*a* being center around the connecting part 28*a* and opposing the first arc-shaped groove 39*a*. The screw bracket 30 can be moved in and along the first and second arc-shaped grooves 39*a* and 40*a*, wherein the movement is centered on the connecting part 28*a*.

The operation will now be described.

When a control signal from the controller is received at the antenna 24, the received control signal is supplied to the controlling unit, not shown in the drawings. The controlling unit that received the control signal in the above described manner controls the various units on the basis of the control signal.

Next, the control of the electric motor will be described.

When the controlling unit operates the electric motor 26, the toy boat 21 moves, and when the controlling unit stops the electric motor 26, the toy boat 21 stops moving. The speed of the toy boat 21 can be increased or decreased by increasing or decreasing the number of revolutions with the controlling unit. According to this embodiment, by storing the electric motor 26, whose weight is large, in the boat body 22, the center of gravity of the boat body 22 is lowered and, as a result, stable movement is achieved.

Next, the steering will be described.

To direct the toy boat 21 to move straight, the support shaft 35, the C-ring member 36, and the shaft end portion 31*c* included in the servo mechanism 31 and the impact absorption mechanism 32 are configured as shown in FIG. 14.

In this configuration, if the servo mechanism 31 is moved by a predetermined amount in order to turn the toy boat 21 leftwards, the servo mechanism 31 moves to the left (clockwise) relative to the impact absorption mechanism 32, as shown in FIG. 15, since the shaft end portion 31*c* is fixed to the support shaft 35 by the-C-ring member 36.

In this way, when the servo mechanism 31 turns, the screw bracket 30 also turns toward the left (clockwise) relative to the impact absorption mechanism 32 since the screw bracket 30 is fixed to the housing 31*a* with the first and second fixing brackets 39 and 40. In this way, steering is possible.

While the toy boat 21 is moving in this way, if, for example, the right side of the screw bracket 30 contacts an obstacle, the screw bracket 30 turns further towards the left (clockwise). At this time, the C-ring member 36 elastically extends and absorbs the impact. After the absorption of the impact is completed, the C-ring member 36 elastically restores its original state.

Next, the adjustment of the angle and the depth of the screw will be described.

First, the fixing screw 41 is loosened and, as shown in FIG. 16, the screw bracket 30 is pivoted around the connecting part 28*a* along the vertical plane while the protrusions 30*a* is guided along the first and second arc-shaped grooves 39*a* and 40*a*. In this way, the screw 29 can be set at a predetermined angle. Then, the fixing screw 41 is tightened, and the protrusions 30*a* are interposed and fixed between the first and second brackets 39 and 40.

As described above, since the toy boat 21 according to the present invention may further include the impact absorption mechanism 32 configured to connect the boat body 22 and the servo mechanism 31, wherein the impact absorption mechanism 32 includes the support shaft 35 having the protrusion extending 35*b* from the outer circumference of a shaft part 35*a* along the shaft direction, wherein the support shaft 35 is mounted on the boat body 22, the shaft end portion 31*c* having the protrusion 31*cb* extending from the outer circumference of the circular cylinder 31*ca* along the shaft direction, wherein the shaft end portion 31*c* is attached to the transmission shaft 31*b* of the servo mechanism 31, and the elastic C-ring member 36 configured to dispose and hold the first and second protrusions 35*b* and 31*cb* in a gap and to embrace the shaft part 35*a* and the circular cylinder 31*ca*, even if the screw bracket 30 contacts an obstacle and receives an impact, the C-ring member 36 extends or contracts so as to absorb the impact. In this way, the servo mechanism 31 is prevented from being damaged.

Since the screw bracket 30 is fixed on the housing 31*a* of the servo mechanism 31, the screw bracket 30 can be directly turned towards a horizontal position by the servo mechanism 31. In this way, a rod configured to transmit power generated at the servo mechanism 31 to the screw bracket 30 for steering and to turn the screw bracket 30 towards a horizontal position is not required. Thus, steering can be adjusted easily.

The electric motor 26 is mounted to the inner side of the boat body 22, the screw 29 is connected to the driving shaft 27, which is driven by the electric motor 26, with the hexagonal universal joint 28 at the outside of the boat body 22, and the screw adjustment mechanism 38 configured to adjust the angle of the screw 29 by pivoting the screw 29 around the connecting part 28*a* connecting the hexagonal universal joint 28 and the driving shaft 27. Therefore, the screw bracket 30 can be turned while being centered around the connecting part 28*a* so as to finely and easily adjust the angle of the screw 29 in accordance with the wave condition and/or the size and type of the screw. Accordingly, the toy boat 21 can be steered in a manner suitable for various conditions.

The servo mechanism 31 is mounted on the outer side of the boat body 22 so that the screw bracket 30 can be turned towards a horizontal position, and the screw adjustment mechanism 38, as shown in FIG. 13, includes a first fixing bracket 39 whose upper edge is attached to the housing 31*a* of the servo mechanism 31, a second fixing bracket 40 attached to the first fixing bracket 39 with a fixing screw 41, and the screw bracket 30 includes the protrusions 30*a* interposed and fixed between the first and second arc-shaped grooves 39*a* and 40*a*. Moreover, the first fixing bracket 39 includes a first arc-shaped groove 39*a* being center around the connecting part 28*a*, the second fixing bracket 40 includes a second arc-shaped groove 40*a* being center around the connecting part 28*a* and opposing the first arc-shaped groove 39*a*, and the screw bracket 30 can be moved in and along the first and second arc-shaped grooves 39*a* and 40*a*, wherein the movement is centered around the connecting part 28*a*. Therefore, the screw bracket 30 can be turned towards a horizontal position by the servo mechanism 31 with the first and second fixing brackets 39 and 40. In this way, a rod configured to transmit power generated at the servo mechanism 31 to the screw bracket 30 for steering and to turn the screw bracket 30 towards a horizontal position is not required. Thus, the steering can be easily adjusted.

Since the plurality (e.g., two) of protrusions 20*a* is provided, the screw bracket 30 can be firmly fixed by the first and second fixing brackets 39 and 40. Since the universal joint is the hexagonal universal joint 28, the toy boat 21 having the above-described advantages may be provided at low cost.

The toy boat 21 transported by the electric motor toy transport trailer 11 according to the above-described embodiment is not limited and may be any electric motor toy, such as a toy automobile or a toy airplane.

In the above-described embodiment, the driving source directly rotates the screw bracket 30. However, the driving source may be mounted on the inner side of the boat body 22, and the servo mechanism may be mounted on the outer side of the boat body 22. In this way, the distance between the servo mechanism 31 and the screw bracket 30 is reduced, enabling the screw bracket 30 to be directly turned towards a horizontal position by the servo mechanism 31. Therefore, a rod configured to transmit power generated at the servo mechanism 31 to the screw bracket 30 for steering and to turn the screw bracket 30 towards a horizontal position is not be required.

In the above-described embodiment, the shaft end portion 31*c* is attached to the transmission shaft 31*b* of the servo mechanism 31. However, the edge of the transmission shaft 31*b* may be formed in the same manner as the shaft end portion 31*c*. In such a case, to gain the same advantages as those of the above-described embodiment, the screw adjustment mechanism may include a first fixing bracket(39), the second bracket (40), and the screw bracket (30), wherein the upper edge of the first fixing bracket (39) is mounted on the boat body 22 so that the first fixing bracket (39) can be turned towards a horizontal position, the first bracket (39) includes the first arc-shaped groove 39*a* centered around the connecting part 28*a*, the second bracket (40) includes the second arc-shaped groove 40*a*, which opposes the first arc-shaped groove 39*a* and is centered around the connecting part 28*a*, and is attached on the first bracket (39), the screw bracket (30) is centered around the connecting part 28*a* and is provided so that the screw bracket (30) is movable in and along the first and second arc-shaped grooves 39*a* and 40*a*, and the screw bracket (30) includes the protrusions 30*a* interposed and fixed between the first and second fixing brackets (39 and 40).

What is claimed is:

1. A transport trailer for transporting and recharging a rechargeable drive power source of an electric motor powered toy boat, the transport trailer comprising:

(i) a trailer body having forward and rearward ends for supporting the toy boat;

(ii) a pair of spaced-apart tires positioned between the forward and rearward ends of the trailer body to permit rolling transport of the trailer body and the toy boat supported thereby across a surface;

(iii) a charger supported by the trailer body, the charger including a rechargeable main power source and being configured to operably connect the main power source to the drive power source of the electric motor powered toy boat so as to charge the drive power source by means of the main power source;

(iv) a container for containing the rechargeable main power source, the container being located between the forward and rearward ends of the trailer body and between the pair of spaced-apart tires, the container having an open upper end for receiving the rechargeable main power source therein; and (v) a cover for covering the open upper end of the container, the cover defining a surface which is positioned below upper edges of the tires so that the container and the rechargeable main power source contained therewithin are positioned below the upper edges of the tires.

2. The transport trailer according to claim 1, wherein the charger includes a charging connector having a cord connected to the rechargeable main power source.

3. The transport trailer according to claim 2, further comprising an openable and closable container box provided on the electric motor toy transport trailer body at the forward end thereof, wherein the charging connector is stored in the container box.

4. The transport trailer according to claim 2, wherein the electric motor toy boat includes a depression on a bottom surface thereof, and wherein the transport trailer further comprises a plurality of protrusions provided on the cover of the rechargeable main power source container which are received within the depression on the bottom surface of the toy boat so as to support the toy boat on the transport trailer.

5. The transport trailer according to claim 1, further comprising an openable and closable container box provided on the electric motor toy transport trailer body at the forward end thereof, wherein a charging connector is stored in the container box.

6. The transport trailer according to claim 1, wherein the electric motor toy boat includes a depression on a bottom surface thereof, and wherein the transport trailer further comprises a plurality of protrusions provided on the cover of the rechargeable main power source container which are received within the depression on the bottom surface of the toy boat so as to support the toy boat on the transport trailer.

7. The transport trailer according to claim 4, wherein the electric motor toy boat includes a depression on a bottom surface thereof and wherein the transport trailer further comprises a plurality of protrusions provided on the cover of the rechargeable main power source container which are received within the depression on the bottom surface of the toy boat so as to support the toy boat on the transport trailer.

8. The transport trailer according to claim 1, further comprising a switch connected to the charger to allow charging of the drive power source by means of the main power source.

9. The transport trailer according to claim 8, further comprising a light-emitting diode operably connected to the switch which illuminates in response to charging of the drive power source by means of the main power source.

* * * * *